United States Patent [19]

Allen

[11] Patent Number: 4,978,824

[45] Date of Patent: Dec. 18, 1990

[54] ELECTRICAL SWITCHES

[75] Inventor: John W. Allen, West Sussex, England

[73] Assignee: Redcliffe Electronics Limited, London, England

[21] Appl. No.: 424,902

[22] Filed: Oct. 20, 1989

Related U.S. Application Data

[63] Continuation of Ser. No. 213,315, Jun. 30, 1988, abandoned.

[30] Foreign Application Priority Data

Jul. 1, 1987 [GB] United Kingdom ..... 8715412

[51] Int. Cl.[5] ..... H01H 5/00

[52] U.S. Cl. ..... 200/447

[58] Field of Search ..... 200/≠A, 200/440–442, 447, 448, 462–467, 424, 431

[56] References Cited

U.S. PATENT DOCUMENTS

| | | | |
|---|---|---|---|
| 2,526,850 | 10/1950 | Charbonneau | 200/447 |
| 2,840,657 | 6/1958 | Roeser | 200/448 X |
| 3,192,329 | 6/1965 | Murrlé | 200/16 A |
| 3,668,347 | 6/1972 | Korsgren | 200/447 |
| 4,347,415 | 8/1982 | Falchi | 200/441 |
| 4,814,558 | 3/1989 | Tanabe | 200/440 |

FOREIGN PATENT DOCUMENTS

| | | |
|---|---|---|
| 3511898 | 10/1986 | Fed. Rep. of Germany . |
| 3531390 | 10/1986 | Fed. Rep. of Germany . |

*Primary Examiner*—J. R. Scott

*Attorney, Agent, or Firm*—Chilton, Alix & Van Kirk

[57] ABSTRACT

In an electrical switch having two stable contact states, e.g., a snap-acting butterfly type switch which includes a spring biased movable actuator mounted in a housing and pivotally engaged by contact carrying arms which are urged together by a tension spring, a fulcrum cooperates with each contact arm during normal operation. During movement of the actuator in a first direction, the contact arms pivot about the fulcrums and the contacts begin to move away from a first stable state. When the horizontal position of the arms is reached, the arms pivot rapidly under influence of the tension spring and the contacts "snap" to the second stable state. During the spring biased return movement of the actuator, the contact arms pivot without contact movement until the horizontal position is passed and snap-action occurs. The switch is characterized by an increased gap between the fixed contact when in the open state and/or by a reduction in the amount of actuator movement required for causing the contacts to move from the open to the closed state.

20 Claims, 6 Drawing Sheets

ELECTRICAL SWITCHES

This is a continuation of co-pending application Ser. No. 213,315, filed on June 30, 1988, now abandoned.

BACKGROUND OF THE INVENTION (1) Field of the Invention

This invention relates to electrical switches and, particularly, with improving the electrical isolation provided by switches.

(2)Description of the Prior Art

Many types of switch are provided with a movable actuator which when moved causes the sudden movement of one or more electrical contacts. It is generally desirable to obtain sudden movements of the contacts (so-called snap action) to reduce problems of arcing and this is often obtained by building up energy in a spring which then causes rapid contact movement. It is a common requirement of electrical switches that they should be operable with a small movement of the actuator, but on the other hand it is desirable that the contacts should be widely separated in the open position to provide high electrical isolation. These requirements are to some extent conflicting: it has proved difficult to design a switch mechanism which provides sudden movement between closed and wide open contact positions in response to small movements of an actuator.

SUMMARY OF THE INVENTION

Viewed from one aspect the invention provides an electrical switch comprising a displaceable actuator, a movable member coupled to said actuator and arranged to move a first electrical contact, said movable member being resiliently biased to have a first stable orientation in which said contact is closed with a second electrical contact, a second stable orientation in which said contacts are open, and an unstable equilibrium orientation intermediate said first and second stable orientations, said movable member being arranged to move between said stable orientations in response to displacement of said actuator, and means for causing said first contact to move in a contact-closing direction as said movable member moves from said second stable orientation towards said unstable orientation, said contacts remaining closed as said movable member moves from said first stable orientation towards said unstable orientation.

Viewed from another aspect the invention provides an electrical switch comprising a displaceable actuator, a pair of contacts, a movable member coupled to said actuator and resiliently biased to have a first stable orientation in which said contacts are closed, a second stable orientation in which said contacts are open and an unstable equilibrium orientation intermediate said first and second stable orientations, said movable member being arranged to move between said stable orientations in response to displacement of said actuator, and means for causing said movable member to move more rapidly from the second stable orientation towards the unstable orientation than from the first stable orientation towards the unstable orientation in response to the same amount of movement of the actuator.

By the above means, a wide separation can be provided between the contacts in the open condition of the switch whilst the switch can be caused to switch into its closed condition by a relatively small movement of the actuator.

Preferably the movable member is arranged to rotate in moving between the first, second and unstable orientations and means are provided for causing rotation around different points on the movable member during movement towards the unstable orientation from the first and second stable orientations respectively. For example, the movable member may be an arm having two ends and arranged to rotate about a point at or adjacent one end during movement from the first stable orientation towards the unstable orientation (i.e. when opening the switch) and about a point intermediate its ends when moving in the opposite direction. These movements are preferably in opposite directions and so the rotation about the intermediate point can be provided by forming a fulcrum to act on one side only of the arm intermediate its ends.

In one preferred form the movable member is a contact arm disposed generally transversely of the actuator, carrying an electrical contact at one end and engaging the actuator at the other end. Movement of the actuator causes rotation of the contact arm about its one end when the switch is closed and about a fulcrum intermediate its ends during closing from the open position.

Thus viewed from another aspect the invention provides an electrical switch comprising a displaceable actuator, and a contact arm carrying a first electrical contact, said contact arm being mounted transversely of said actuator, coupled at one end to said actuator, and resiliently biased so as to cause said first contact to engage and disengage a second contact in response to movement of said actuator, and said contact arm being arranged to pivot about a fulcrum positioned between said first contact and said one end during contact-closing operation only.

Preferably said actuator is movable in directions into and out of a hollow housing, said second contact is fixedly mounted within said housing and said contact arm pivotally engages said actuator at said one end and carries said first contact at its other end. When the contacts are closed and the actuator moves to open the switch the contact arm pivots about the fixed contact. When the contacts are open and the actuator moves to close the switch the contact arm pivots about said fulcrum intermediate its ends and in each case said one end of said contact arm is moved by the actuator. The fulcrum may be mounted on the contact arm to engage the housing but preferably it is mounted on the housing to engage the contact arm during closing movement of the switch.

Viewed from another aspect the invention provides an electrical switch having a housing, a terminal mounted in the housing for connection to a conductor, means for mechanically engaging said switch to a second, similar, switch for operation in tandem therewith, and an insulating portion connected to the housing and shaped and positioned so as to substantially prevent access to a said terminal of said second switch when said switches are mechanically engaged.

Preferably each switch includes a movable actuator extending outwardly from a first face thereof and able to operate the actuator of a similar switch through a second face opposite said first face, said terminal being disposed in the region of said second face and said insulating portion extending from said housing beyond said first face. Said insulating portion preferably also carries means for engaging the housing of the second switch. Preferably said engaging means comprises a resiliently mounted pip arranged to enter a corresponding recess in the housing of the second switch.

BRIEF DESCRIPTION OF THE DRAWINGS

Some embodiments of the invention will now be described by way of example only and with reference to the accompanying drawings, in which.

DESCRIPTION OF THE DISCLOSED EMBODIMENTS

Figure 1:
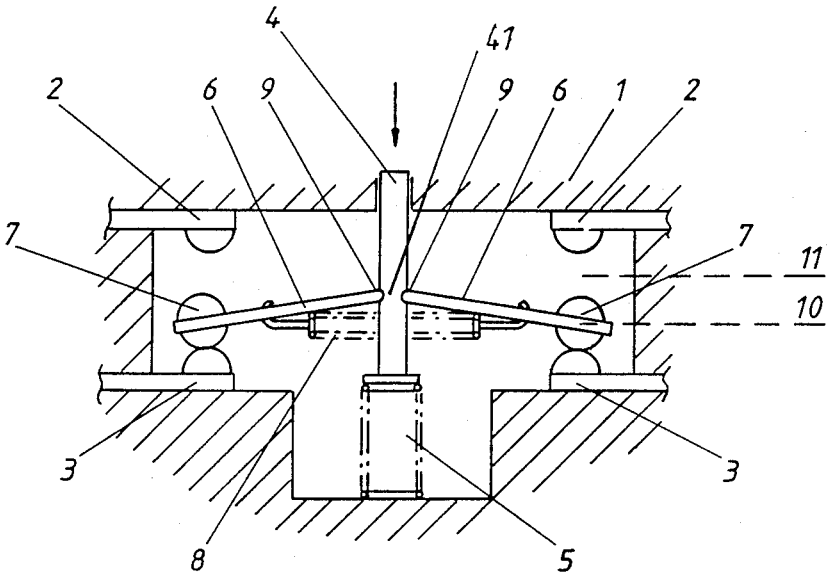
Fig. 1 PRIOR ART
FIG. 1 is a schematic view illustrating the principle of operation of a known butterfly switching mechanism.

Referring first to FIG. 1, a prior design of "double-leaf" or "butterfly" switch mechanism is illustrated. Two pairs of contacts, 2 and 3, are fixedly mounted within a housing 1. An actuator 4 is linearly movable within the housing 1 and is biased upwardly by compression spring 5. Mounted generally transversely of the actuator 4 are a pair of conductive contact arms 6. The arms 6 carry at one end movable contacts 7 and at their other ends rest in notches 9 in the actuator 4. The actuator 4 is electrically conductive at least in the region 41 of the notches 9 so as to interconnect the two contact arms 6. The two contact arms 6 are joined together by a tension spring 8 which passes through slots in the contact arms 6 and the actuator 4.

The switch of FIG. 1 is arranged to interconnect either the contacts 3 or the contacts 2. In its normal resting condition illustrated it interconnects the contacts 3. If the actuator 4 is moved in the direction of the arrow the contact arms pivot about the points of contact between contacts 3 and contacts 7 and rotate to become more nearly horizontal. The tension and potential energy in spring 8 gradually increase until a point of unstable equilibrium is reached in which the arms 6 are horizontal. At this point the notches 9 are positioned on the line 10. A slight further movement in the direction of the arrow will cause the movable contacts 7 to snap upwardly under the influence of spring 8 so that the fixed contacts 2 are interconnected via the contacts 7, contact arms 6 and actuator 4, and the connection between contacts 3 is broken.

When the actuator 4 is released a symmetrical action occurs; when the contact arms 6 are again horizontal, i.e. when the notches 9 are at the level 11, the contacts 7 snap back into the position shown in FIG. 1. It will be appreciated that the necessary amount of movement of the actuator 4 to operate the switch between its two conditions (the distance between levels 10 and 11) is substantially equal to the gap between the contacts 2 and 7 in the position shown. The total voltage isolation gap between contacts 2 is thus substantially twice the operating movement of the actuator 4 and it follows that to obtain a high degree of isolation a relatively large actuator movement is required. A typical application to provide voltage isolation in consumer equipment may require a total gap between the open contacts of greater than 3 mm whereby an actuator movement of more than 1.5 mm will be necessary. This is undesirably large for many applications.

Figure 2:
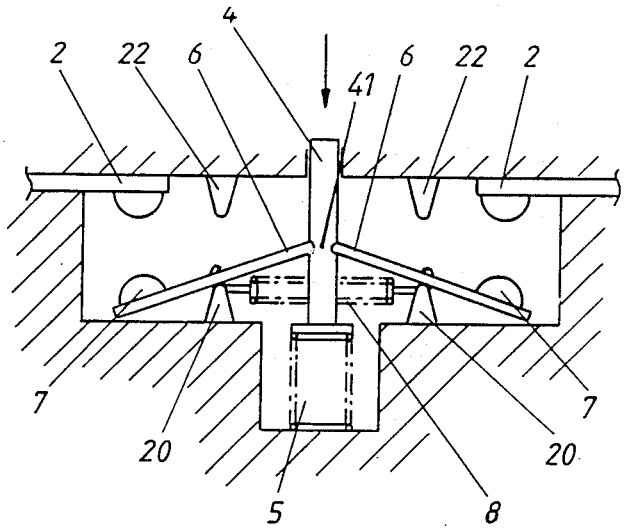
FIG. 2 is a similar schematic view illustrating a normally-open switch according to the invention in its normally-open condition.
Figure 2A:
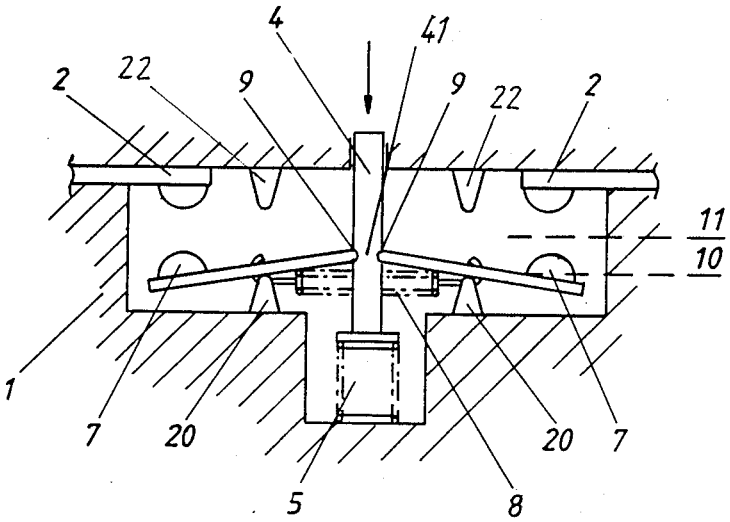
FIG. 2*a* shows the switch of FIG. 2 moving towards its closed condition.
Figure 3:
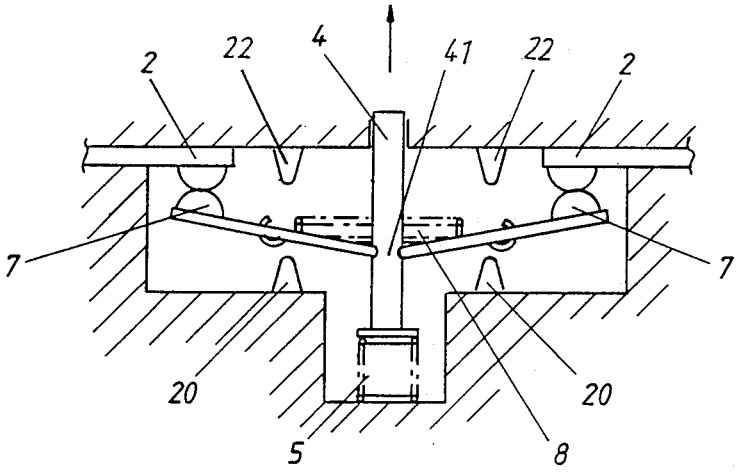
FIG. 3 shows the switch of FIG. 2 in its closed condition.
Figure 3A:
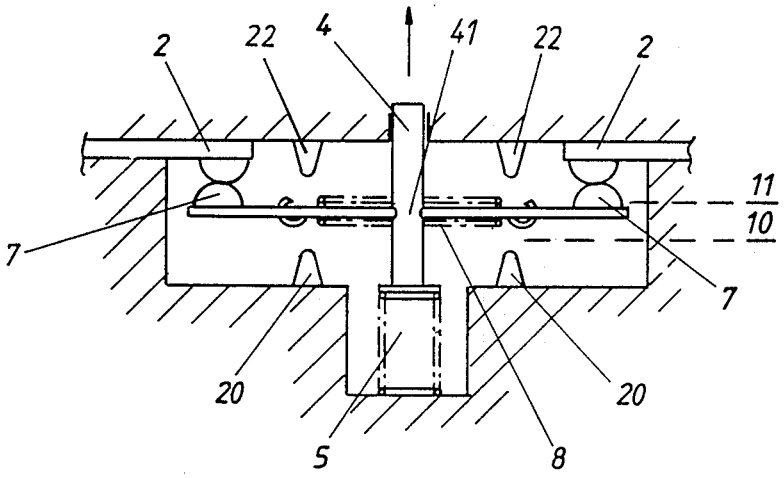
FIG. 3*a* shows the switch of FIG. 2 moving towards its open condition.
Figure 4:
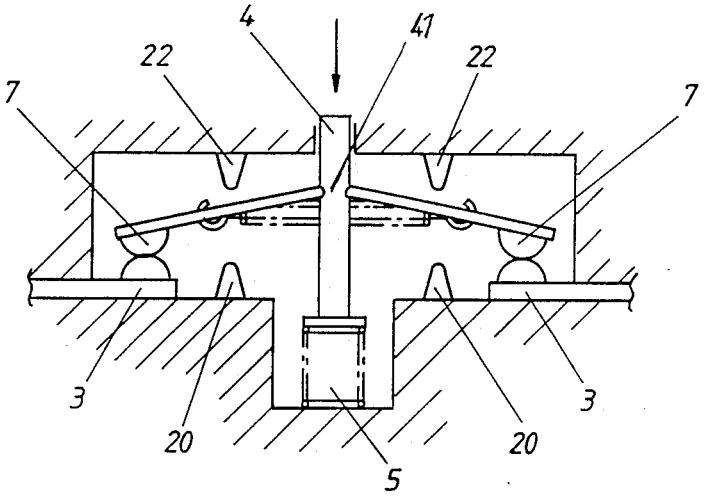
FIG. 4 shows a normally closed switch according to the invention in its closed condition.
Figure 5:
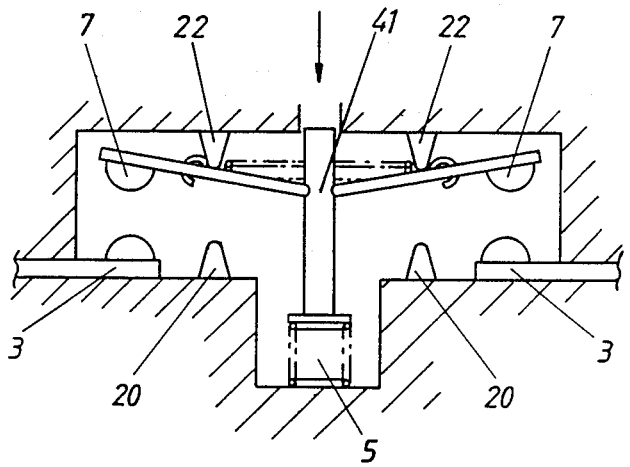
FIG. 5 shows the switch of FIG. 4 in its open condition.

FIGS. 2 to 3*a* show a normally-open switch according to the invention and FIGS. 4 and 5 show a normally-closed switch according to the invention. The switch of FIG. 2 differs from that of FIG. 1 in that it does not have the, fixed contacts 3 but it is additionally provided with non-conductive fulcrums 20 in the housing 1. The fulcrums 20 may, for example, be integrally moulded with the housing. In the open condition of the switch shown in FIG. 2 the contact arms 6 are pivoted downwardly to reach the housing 1. The fulcrums 20 are shaped and positioned so as not to hinder this full opening movement. As the actuator 4 is moved in the direction of the arrow in FIG. 2 to close the switch, each contact arm 6 engages a corresponding fulcrum 20 and pivots about a point intermediate its ends as shown in FIG. 2*a*. Eventually a position of unstable equilibrium is reached with the arms 6 horizontal. At this point notches 9 are positioned on line 10. During the movement from the fully open position to the unstable equilibrium position the contacts 7 begin to move in a contact-closing direction. Also, the arms 6 rotate more rapidly than they would if pivoted about their contact-carrying ends, for the same amount of movement of the actuator 4. After the horizontal position of the arms 6 has been reached, a small further movement in the direction of the arrow in FIG. 2*a* results in the movable contacts 7 snapping into the position shown in FIG. 3 to close with the contacts 2 and thereby interconnect the contacts 2.

If the actuator 4 is now released so as to move in the direction of the arrow in FIG. 3, the contact arms 6 pivot about the points of contact between contacts 2 and contacts 7. Eventually a horizontal position as shown in FIG. 3*a* is reached in which the notches 9 are at the level 11 and after a small further movement the contacts 7 snap into their fully open position shown in FIG. 2.

It will be seen that no separating movement of the contacts 2 and 7 takes place between the positions of FIGS. 3 and 3*a* but thereafter a sudden movement to the fully open position takes place, thus reducing any problems caused by arcing on interruption of the current flowing between contacts 2. Furthermore, it may be seen that the voltage isolation gap with the switch in the open condition shown in FIG. 2 is substantially greater than the necessary amount of operating movement of the actuator 4, which is the distance between levels 10 and 11.

It will be noted that fulcrums 22 are also provided in the housing 1 and that these form no part in the operation described above. These fulcrums are used in the normally-closed version of the switch described below with reference to FIGS. 4 and 5 and they are included in the switch of FIG. 2 to 3*a* merely to enable the same housing to be used for either configuration of switch. Similarly, the fulcrums 20 take no part in the operation of the normally-closed switch.

Referring now to FIG. 4, the normally-closed switch is similar to the normally-open switch of FIG. 2 except that contacts 3 are provided instead of contacts 2 and the contact arms 6 are inverted. The normally closed condition is shown in FIG. 4 and the switch is actuated to its open condition by depressing the actuator 4 in the direction of the arrow. As before, when the contact arms 6 become horizontal they snap upwardly to open the switch. During movement from the position of FIG. 4 to the horizontal orientation, the arms 6 pivot about the points of contact of the contacts 3 and 7. As indicated in FIG. 5, during the opposite movement the contact arms pivot about the fulcrum 22 until the horizontal position is reached when they snap into the position of FIG. 4. Again, during the contact-closing movement, the arms 6 rotate more rapidly than during the contact-opening movement for the same amount of movement of the actuator 4 and the contacts 7 begin to move in the contact-closing direction before the position of unstable equilibrium is reached.

Figure 6:
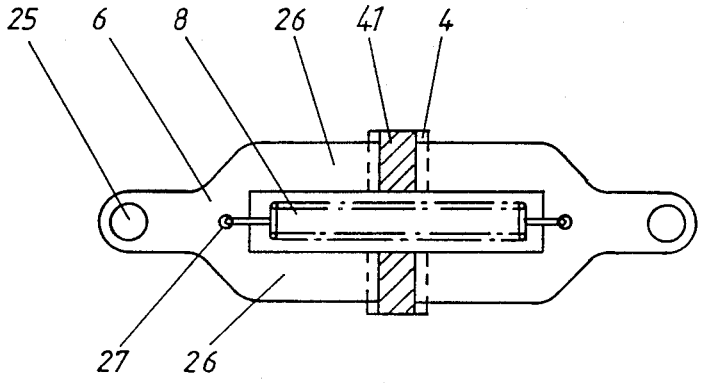
FIG. 6 is a sectional plan view of the mechanism of the switch of FIG. 2 or FIG. 4.
Figure 7:
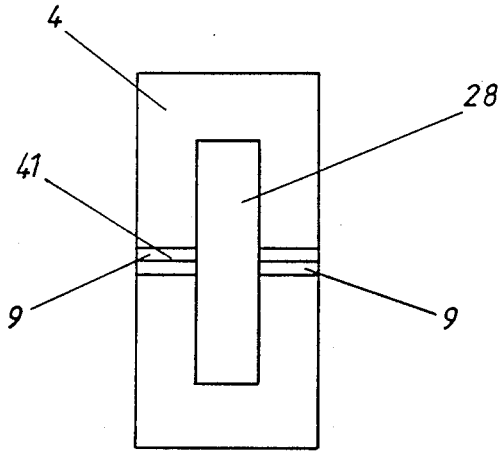
FIG. 7 is an elevation of an actuator.
Figure 8:
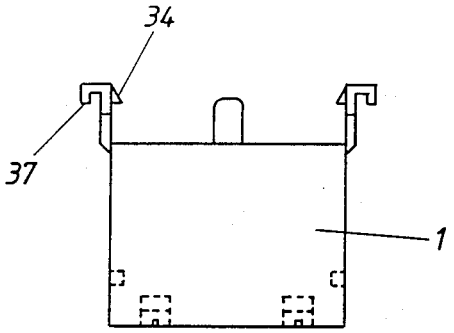
FIGS. 8 and 9 are side and end views respectively of a switch according to the invention.
Figure 9:
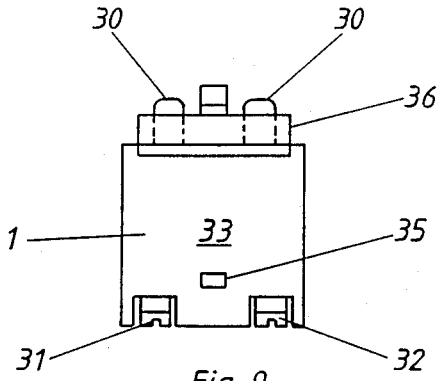

Details of the construction of the switches of 2 and 4 will now be described with reference to FIGS. 6 and 7. Referring to FIG. 6, each contact arm 6 is made of a conductive material, such as brass, and carries a contact dot 25. It is forked to form two separate legs 26 with a gap therebetween to provide a space for spring 8 which is hooked at its end in a hole 27. Each leg 26 is formed into a knife edge at its end and engages in a notch 9 in the actuator 4. The actuator 4 is conductive at least in the region 41 of the notches 9 so as to interconnect the two contact arms 6. The actuator 4 is mounted for slideable movement in the housing 1, for example in vertical channel-shaped guides and a slot 28 is formed in the center of the actuator 4 to allow the spring 8 to pass therethrough.

Although the fulcrums have been described as being formed in the housing 1 they can alternatively be formed on the contact arms 6 on the side facing away from the fixed contact 2 or 3 as the case may be.

A number of other modifications may be made without departing from the invention. Indeed, the invention is of course not restricted to butterfly-type switches but may be applied to other types of switch, including those with only a single contact arm or equivalent movable member.

Figure 10:
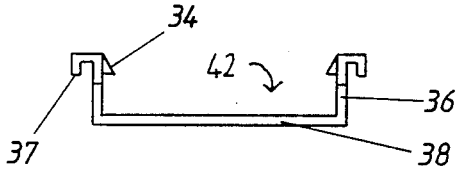
FIGS. 10 and 11 are side and end views respectively of a cover member for the switch.
Figure 11:
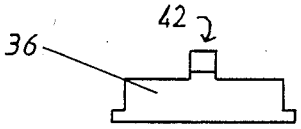
Figure 12:
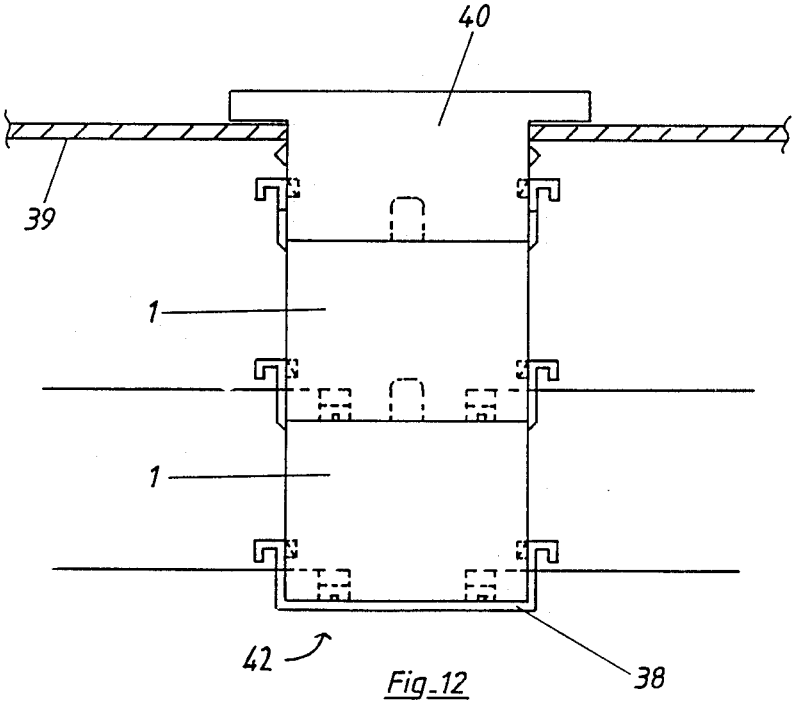
FIG. 12 illustrates the assembly into a single unit of two switches according to the invention.

FIGS. 8 to 12 show arrangements for improving the electrical isolation of terminals provided in the switch. The switch housing 1 shown in FIGS. 8 and 9 in fact can hold two switches of the kind shown in FIG. 2 or FIG. 4 as indicated by the presence of two actuator buttons 30 extending from a top face of the switch in FIG. 9. Mounted in the region of the opposite bottom face are four terminals 31 for connection to electrical conductors. When connected, the conductors emerge from apertures 32 in the end faces 33 of the housing, through which apertures the terminals 31 are accessible. In practice a number of switches may be mechanically interengaged for operation in tandem as illustrated in FIG. 12. In this case the actuator buttons 30 of the lower switch are actuated by the actuators of the upper switch. Means are provided for mechanically engaging the switches, in the form of a resiliently mounted pip 34 arranged to enter complementary recesses 35. Each switch has extending above its side wall 33 above the upper face a short side wall 36 which when two switches are engaged as shown in FIG. 12 substantially covers the apertures 32 and prevents access thereto. The pips 34 may be carried by an upward extension of the walls 36 and the walls 36 may be integrally moulded with the housing 1. A recess 37 is provided in the extension to allow the pips 34 to be withdrawn from the recesses 35 using a suitable levering tool. It will be noted that the top face of the lower switch prevents access to the bottom of the terminals of the upper switch and the side walls 36 of the lower switch prevent access to the sides of the terminals of the upper switch.

FIGS. 10 and 11 show a base cover member 42 for covering the bottom of the lowest switch. It is formed with side walls 36 similar to the switch housing and with a plain flat base 38. FIG. 12 illustrates two switch housings 1 and a base cover 42 all mounted in a panel 39 via a button assembly 40.

What is claimed is:

1. A snap action electrical switch comprising:

a housing;

a displaceable actuator at least in part disposed within said housing;

first electrical contact means mounted within said housing for defining a portion of a path for the flow of electrical current through said housing said first contact means including a stationary electrical contact;

at least a second electrical contact means disposed within said housing for cooperation with said first contact means in defining said current flow path, said second contact means including a movable electrical contact, said stationary and movable contacts having at least a first relative orientation in which said contacts having at least a first relative orientation in which said contacts are spaced apart and a second relative orientation in which said movable contact is in contact with said stationary contact;

means establishing a path for the flow of electrical current between said first electrical contact means and the exterior of said housing;

at least a first movable member coupled to said actuator and to said second electrical contact means movable contact, said first movable member imparting movement to said movable electrical contact in response to displacement of said actuator;

means for resiliently biasing said first movable member whereby said first movable member has at least a first orientation, a second orientation and an unstable equilibrium orientation intermediate said first and second orientations, said first orientation of said first movable member corresponding to said first relative orientation of said contacts and said second orientation of said first movable member corresponding to said second relative orientation of said contacts, said first movable member being arranged to move between said first and second orientations in response to displacement of said actuator, at least one of said first and second orientations of said first movable member being a stable orientation;

means cooperating with said first movable member for causing said movable electrical contact to move towards said stationary electrical contact in a contact-closing direction as said first movable member moves from said first orientation towards said unstable orientation, said contacts remaining closed as said first movable member moves from said second orientation towards said unstable orientation; and means for establishing a path for the flow of electrical current between said second electrical contact means and the exterior of said housing.

2. The switch of claim 1 wherein said first movable member is an elongated arm, said arm pivoting in a first direction in moving from one of said orientations thereof towards the unstable orientation and pivoting in a second direction opposite to said first direction when moving from the other of said orientations thereof toward the said one orientation, said pivotal motion of said first movable member in said first and second directions being about different points on said first movable member.

3. The switch of claim 2 wherein said movable electrical contact is mounted on said arm, said arm having two oppositely disposed ends and pivoting about a first point adjacent one of said ends during movement in said first direction, and wherein said means cooperating with said first movable member causes said arm to pivot about a second point intermediate its ends when moving in the second direction, said first and second points being spatially displaced.

4. The switch of claim 1 wherein said first movable member is a contact arm having a pair of oppositely disposed ends, said contact arm being disposed generally transversely with respect to the direction of motion of said actuator during displacement thereof, said movable electrical contact being mounted on said contact arm adjacent one end thereof, said contact arm engaging said actuator adjacent the other end of said arm, movement of said actuator when said contacts are in said second relative orientation and the switch is in the closed condition causing said contact arm to pivot about said stationary contact until said contact arm moves from said second orientation thereof to said unstable orientation, said contact arm pivoting about said means cooperating with said movable member in response to movement of said actuator during closing of the switch from the open position where said contacts are in said first relative orientation, said means cooperating with said movable member comprising a fulcrum which engages said contact arm intermediate its ends.

5. An electrical switch comprising:

a housing;

a displaceable actuator disposed within said housing;

at least a first pair of electrical contacts disposed within said housing;

means establishing paths for the flow of electrical current between said electrical contacts and the exterior of said housing;

at least a first movable member coupled to said actuator and to one of said electrical contacts, said first movable member imparting movement to said one of said contacts;

means for resiliently biasing said first movable member whereby said first movable member will have a first orientation in which said contacts are closed, a second orientation in which said contacts are open and unstable equilibrium orientation intermediate said first and second orientations, said first movable member moving between said first and second orientations in response to displacement of said actuator, at least one of said first and second orientations being a stable orientation; and means for causing said first movable member to move more rapidly in a first direction from the second orientation towards the unstable orientation than in a second direction from said first orientation towards the unstable orientation in response to the same amount of initial displacement of said actuator.

6. The switch of claim 5 wherein said first movable member rotates in moving between the first, second and unstable orientations and wherein said means for causing said first movable member to move more rapidly in said first direction than in said second direction comprises abutment means for causing rotation of the said first movable member about different spacially displaced points on the said first movable member during movement towards the unstable orientation from the first and second orientations respectively.

7. The switch of claim 6 wherein said first movable member comprises an arm, a first of said electrical contacts of said pair being mounted on said arm, said arm having two ends and being arranged to rotate about a first of said points located adjacent one of said ends during movement from the first orientation towards the unstable orientation and about the second of said points located intermediate its ends when moving in the second direction, said abutment means contacting said arm at said second point.

8. The switch of claim 5 wherein said first movable member comprises a contact arm, said contact arm having a pair of opposite ends and being arranged generally transversely with respect to the direction of displacement of said actuator, said one of said electrical contacts of said pair being mounted on said contact arm adjacent one end thereof, said actuator engaging said contact arm adjacent the other end thereof, displacement of said actuator causing rotation of said contact arm about said one electrical contact when the switch is in the closed condition and causing rotation of said arm about said means for causing said first movable member to move more rapidly in a first direction than in a second direction during closing from the open condition, said means for causing said arm to move more rapidly in a first direction than in a second direction comprising a fulcrum.

9. A snap action electrical switch comprising:

a hollow housing;

a displaceable actuator at least in part mounted within said housing;

at least a first movable elongated contact arm disposed within said housing, said first contact arm extending generally transversely with respect to the direction of displacement of said actuator and being rotatably coupled at one end to said actuator;

a first electrical contact means positioned within said housing, said first contact means including a first movable electrical contact mounted on said first contact arm;

at least a second electrical contact means disposed within said housing for cooperation with said first electrical contact means, said second contact means including a second stationary electrical contact;

means for establishing paths for the flow of electrical current between said first and second electrical contacts and the exterior of said housing;

means resiliently biasing said first contact arm for causing said first electrical contact to engage and disengage said second electrical contact in response to displacement of said actuator; and a fulcrum positioned to engage said first contact arm from a first side thereof at a point located between said first electrical contact and said one end of said arm whereby said first contact will pivot about said fulcrum only during movement of said first electrical contact towards said second electrical contact from a position where it is disengaged from said second electrical contact.

10. The switch of claim 9 wherein said actuator is reciprocally movable into and out of said housing, said second contact is fixedly mounted within said housing and said first contact arm pivotally engages said actuator at said one end and carries said first contact adjacent its other end, said first contact arm being resiliently biased by said biasing means so that during initial movement of said actuator when the said first and second contacts are engaged and the switch is closed said first contact arm pivots about said second electrical contact, and during initial movement of said actuator when said first and second electrical contacts are disengaged and the switch is open said first contact arm pivots about said fulcrum intermediate the ends of said contact arm and in each case said one end of said contact arm is moved by said actuator.

11. The switch of claim 9 wherein said fulcrum is mounted to said housing and engages said first contact arm during closing movement of the switch.

12. A snap action electrical switch comprising:

means defining a housing;

a displaceable actuator at least partly disposed within said housing;

a first electrical contact means disposed within said housing, said first contact means including a first electrical contact;

at least a second electrical contact means disposed within said housing, said second contact means including a second electrical contact;

means establishing a path for the flow of electrical current between said second electrical contact and the exterior of said housing;

a movable member coupled to said actuator and to said first electrical contact, said movable member imparting movement to said first electrical contact in response to displacement of said actuator;

means for resiliently biasing said first movable member whereby said first movable member will have a first orientation in which said first electrical contact is closed with said second electrical contact, a second orientation in which said electrical contacts are spaced apart to define an open switch and an unstable equilibrium orientation intermediate said first and second orientations, said first movable member moving between said first and second orientations in response to movement of said actuator, at least one of said first and second orientations being a stable orientation;

means positioned on said housing and cooperating with said first movable member for causing said first electrical contact to move in a contact-closing direction when said first movable member moves from said second orientation towards said unstable orientation, said electrical contacts remaining closed as said first movable member moves from said first orientation towards said unstable orientation; and means for establishing a path for the flow of electrical current from said first electrical contact to the exterior of said housing.

13. An electrical switch comprising:

means defining a housing;

a displaceable actuator at least partly disposed within said housing;

a pair of first electrical contacts disposed within said housing;

a pair of second electrical contacts mounted within said housing for cooperation with respective of said first electrical contacts of said pair of first electrical contacts;

means establishing a path for the flow of electrical current from the said second electrical contacts to the exterior of said housing;

first and second movable members respectively coupled to said actuator and respective of said first electrical contacts, said movable members imparting movement to said first electrical contacts in response to displacement of said actuator;

means for resiliently biasing said movable members whereby said members each have a first orientation in which said first contacts are closed with respective of said second electrical contacts, a second orientation in which said electrical contacts are open, and an unstable equilibrium orientation intermediate said first and second orientations, said movable members moving between said first and second orientations in response to displacement of said actuator, at least one of said first and second orientations being a stable orientation;

means cooperating with said movable members for causing said first electrical contacts to move in a contact-closing direction as said movable members move from said second orientation towards said unstable orientation, said electrical contacts remaining closed as said movable members move from said first orientation towards said unstable orientation; and means establishing a path for flow of electrical current from said first electrical contacts to the exterior of said housing.

14. An electrical switch comprising:

means defining a housing;

a displacement actuator at least partly disposed within said housing;

a first pair of electrical contacts disposed within said housing;

at least a second pair of electrical contacts mounted within said housing for cooperation with respective contacts of said first pair of electrical contacts;

means establishing a path for the flow of electrical current from said second electrical contacts to the exterior of said housing;

a pair of movable members coupled to said actuator and respective of said first electrical contacts, said movable members imparting movement to the associated contact of said first pair of electrical contacts in response to displacement of said actuator;

means for resiliently biasing said movable members whereby said movable members have a first orientation in which said contacts of said first pair are closed with respective contacts of said second pair, a second orientation in which said contact are open and unstable equilibrium orientation intermediate said first and second orientations, said movable members moving between said first and second orientations in response to displacement of said actuator, at least one of said first and second orientations being a stable orientation;

means positioned on said housing and cooperating with said movable members for causing said first contacts to move in a contact-closing direction as said movable members move from said second orientation towards said unstable orientation, said contacts remaining closed as said movable members move from said first orientation towards said unstable orientation; and means establishing a path for the flow of electrical current from said first electrical contacts to the exterior of said housing.

15. An electrical switch comprising:

means defining a housing;

a displaceable actuator at least partly disposed within said housing;

at least a pair of electrical contacts disposed within said housing;

means establish a path for the flow of electrical current between said electrical contacts and the exterior of said housing;

at least a first movable member coupled to said actuator and a first of said electrical contacts, said movable member imparting movement to said first electrical contact in response to displacement of said actuator;

means for resiliently biasing said first movable member whereby said first movable member will have a first orientation in which said first electrical contact is closed with the other of said electrical contacts, a second orientation in which said electrical contacts are open and an unstable equilibrium orientation intermediate said first and second orientations, said first movable member moving between first and second orientations in response to displacement of said actuator, at least one of said first and second orientations being a stable orientation; and means positioned on said housing and cooperating with said first movable member for causing said first movable member to move more rapidly in a first direction from the second orientation towards the unstable orientation than in a second direction from the first orientation towards said unstable orientation in response to the same amount of initial displacement of said actuator.

16. An electrical switch comprising:

means defining a housing;

a displaceable actuator at least partly disposed within said housing;

a first pair of electrical contacts disposed within said housing;

at least a second pair of electrical contacts disposed within said housing;

means establishing a path for the flow of electrical current between said electrical contacts and the exterior of said housing;

a pair of movable members coupled to said actuator, said movable members also being respectively coupled to a first electrical contact of one of said pairs of contacts, said movable members imparting movement to said first electrical contacts in response to displacement of said actuator;

means for resiliently biasing said movable members whereby said movable members will each have a first orientation in which said first electrical contacts are closed with respective of the other of said electrical contacts of said pairs of contacts, a second orientation in which said electrical contacts are open and an unstable equilibrium orientation intermediate said first and second orientations, said movable members moving between said first and second orientations in response to displacement of said actuator, at least one of said first and second orientations being a stable orientation; and means cooperating with said movable members for causing said movable members to move more rapidly in a first direction from the second orientation towards the unstable orientation than in a second direction from the first orientation towards said unstable orientation in response to the same amount of initial displacement of said actuator.

17. An electrical switch comprising:

means defining a housing;

a displaceable actuator at least partly disposed within said housing;

a first pair of electrical contacts disposed within said housing;

at least a second pair of electrical contacts disposed within said housing;

means establishing a path for the flow of electrical current between said electrical contacts and the exterior of said housing;

a pair of movable members coupled to said actuator, each of said actuators also being coupled to a first electrical contact of a respective one of said pairs of electrical contacts, said movable members imparting movement to said first electrical contacts in response to displacement of said actuator;

means for resiliently biasing said movable members whereby said movable members will each have a first orientation in which said first electrical contacts are closed with respective of the other of said electrical contacts of said pairs of contacts, a second orientation in which said electrical contacts are open and an unstable equilibrium orientation intermediate said first and second orientations, said movable members moving between said first and second orientations in response to displacement of said actuator, at least one of said first and second orientations being a stable orientation; and means positioned on said housing and cooperating with said movable members for causing said movable members to move more rapidly in a first direction from the second orientation towards the unstable orientation than in a second direction from the first orientation towards said unstable orientation in response to the same amount of initial displacement of said actuator.

18. A snap action electrical switch comprising:

means defining a hollow housing;

a displaceable actuator at least in part mounted within said housing;

at least a first elongated contact arm disposed within said housing, said first contact arm being movable transversely with respect to the direction of displacement of said actuator and being coupled at a first end thereof to said actuator;

first contact means disposed within said housing, said first contact means including at least a first electrical contact mounted on said first contact arm;

a second contact means disposed within said housing, said second contact means including a second electrical contact which cooperates with said first electrical contact;

means for establishing paths for the flow of electrical current between said first and second electrical contacts and the exterior of said housing;

means for resiliently biasing said first contact arm to cause said first electrical contact to engage and disengage said second electrical contact in response to displacement of said actuator; and a fulcrum positioned on said housing, said fulcrum engaging said first contact arm between said first electrical contact and said one end, said first contact arm pivoting about said fulcrum only during movement of said first electrical contact towards said second electrical contact.

19. An electrical switch comprising:

means defining a hollow housing;

a displaceable actuator at least in part mounted within said housing;

at least a first pair of elongated contact arms disposed within said housing, said contact arms being movable transversely with respect to the direction of displacement of said actuator, each of said contact arms being coupled at a first end thereof to said actuator;

a first pair of electrical contacts, said contacts of said first pair being mounted on respective of said contact arms of said first pair of contact arms;

at least a second pair of electrical contacts disposed within said housing for cooperation with respective of said electrical contacts of said first pair of contacts;

means for establishing paths of the flow of electrical current between said electrical contacts and the exterior of said housing;

means for resiliently biasing said contact arms to cause said electrical contacts of said first pair to engage and disengage associated electrical contacts of said second pair in response to displacement of said actuator; and at least a pair of fulcrums, said fulcrums being positioned to engage said contact arms between said electrical contacts of said first pair and said contact arm first ends, said contact arms pivoting about said fulcrums only during movement of said electrical contacts of said first pair towards said electrical contacts of said second pair.

20. An electrical switch comprising:

means defining a hollow housing;

a displaceable actuator at least in part mounted within said housing;

at least a first pair of elongated contact arms disposed within said housing, said contact arms being movable transversely with respect to the direction of displacement of said actuator, each of said contact arms being coupled at a first end thereof to said actuator;

a first pair of electrical contacts, said contacts of said first pair being mounted on respective of said contact arms;

at least a second pair of electrical contacts disposed within said housing for cooperation with respective of said electrical contacts of said first pair of contacts;

means for establishing paths for the flow of electrical current between said electrical contacts and the exterior of said housing;

means for resiliently biasing said contact arms to cause said electrical contacts of said first pair to engage and disengage associated electrical contacts of said second pair of contacts in response to displacement of said actuator; and at least a pair of fulcrums mounted on said housing, said fulcrums being positioned to engage respective of said contact arms between said electrical contacts of said first pair of contacts and said contact arm first ends, said contact arms pivoting about said fulcrums only during movement of said electrical contacts of said first pair of contacts towards said electrical contacts of said second pair of contacts.

* * * * *

UNITED STATES PATENT AND TRADEMARK OFFICE

CERTIFICATE OF CORRECTION

PATENT NO. : 4,978,824

DATED : December 18, 1990

INVENTOR(S) : John W. Allen

It is certified that error appears in the above-identified patent and that said Letters Patent is hereby corrected as shown below:

Column 6:

Claim 1, lines 16 and 17, delete "having at least a first relative orientation in which said contacts".

Column 8:

Claim 9, line 29, after "contact" insert -- arm --.

Column 10:

Claim 14, line 24, after "and" insert -- an --.

Column 11:

Claim 15, line 7, change "establish" to -- establishing --.

Claim 15, line 22, after "between" insert -- said --.

Column 13:

Claim 19, line 18, change "of" to -- for --(1st. occurrence).

Signed and Sealed this

Tenth Day of November, 1992

*Attest:*

*Attesting Officer*

DOUGLAS B. COMER

*Acting Commissioner of Patents and Trademarks*